US005716041A

United States Patent [19]

Groves

[11] Patent Number: 5,716,041

[45] Date of Patent: Feb. 10, 1998

[54] ADJUSTABLE GATE STRUCTURE

[76] Inventor: Michael F. Groves, P.O. Box 7288, Bend, Oreg. 97708

[21] Appl. No.: 799,349

[22] Filed: Feb. 13, 1997

[51] Int. Cl.[6] ..... E06B 11/00

[52] U.S. Cl. ..... 256/73; 256/24; 49/55

[58] Field of Search ..... 256/73, 24, DIG. 2; 49/55

[56] References Cited

U.S. PATENT DOCUMENTS

| | | | |
|---|---|---|---|
| 96,783 | 11/1869 | Davis . | |
| 524,040 | 8/1894 | Godwin | 49/55 X |
| 689,240 | 12/1901 | Sprague | 256/73 X |
| 758,559 | 4/1904 | Oppenheim | 49/55 X |
| 851,936 | 4/1907 | Hendrich | 256/73 X |
| 1,298,072 | 3/1919 | McNabney et al. | 256/73 |
| 3,290,014 | 12/1966 | Stapleton | 256/73 |
| 3,395,489 | 8/1968 | Banse . | |
| 4,628,635 | 12/1986 | Maillard . | |
| 4,793,098 | 12/1988 | Wilkerson . | |
| 4,796,384 | 1/1989 | Warwick . | |
| 4,813,182 | 3/1989 | Daniels et al. . | |

FOREIGN PATENT DOCUMENTS

| | | | |
|---|---|---|---|
| 883081 | 11/1961 | United Kingdom | 256/73 |

*Primary Examiner*—Anthony Knight
*Attorney, Agent, or Firm*—Robert D. Varitz

[57] ABSTRACT

An adjustable gate is suitable for use with a fence and includes a pair of spaced apart vertical members, upper and lower first slip members, which are attached to the vertical member, upper and lower second slip members, which extend between the upper and lower first slip members, respectively, and which are slip-fit thereon and slidable relative thereto, allowing the gate width to be slidably adjustable to a predetermined distanced such that the gate substantially fills an opening in a fence. Upper and lower fixed-length members are mounted on the assembled upper and lower slip members for fixing the gate to a selected width. The upper and lower first slip members may be pivotally attached to the vertical members and a truss provided, which mass extends between the upper portion of one vertical member and the lower portion of the other vertical member to maintain the gate in a predetermined parallelographic orientation.

17 Claims, 4 Drawing Sheets

ADJUSTABLE GATE STRUCTURE

FIELD OF THE INVENTION

This invention relates to gates, specifically to a terrain-following, adjustable width gate that may be covered with a variety of web materials.

BACKGROUND OF THE INVENTION

In many instances, the width of a gate opening in a fence is not readily ascertainable before the fence is constructed. This leaves the fence builder with the option of waiting to install a gate until a custom-made gate can be constructed, or trying to fit a gate into the opening. To this end, a number of mechanisms have been disclosed for adjusting the width of a gate.

Wilkerson, U.S. Pat. No. 4,793,098 discloses a gate frame structure which has predetermined scores along a horizontally extending member thereof, which allows the width of the gate to be adjusted in predetermined increments through the use of a hack saw. A variety of slip-joint structures are known which allow the gate width to be adjusted.

Another difficulty encountered when installing a gate is that the fence may not be built on level terrain. This usually results in a gate which does not evenly follow the terrain, with the gate having a greater spacing between the ground and one side of the gate than between the ground and the other side of the gate. This issue of gate construction was addressed by Davis, U.S. Pat. No. 96,783 in 1869. That patent, however, merely allowed adjustment of the gate over a slight range and was primarily directed at curing the problem of gate sag.

None of the known adjustable gate structures fully accomplish the goal of providing a gate which has an adjustable width and is also capable of following ground contour.

SUMMARY OF THE INVENTION

The adjustable gate of the invention is suitable for use with a fence, or other fixed structure, and includes a pair of spaced apart vertical members, upper and lower first slip members, which are attached to the vertical member, upper and lower second slip members, which extend between the upper and lower first slip members, respectively, and which are slip-fit thereon and slidable relative thereto, allowing the gate width to be slidably adjustable to a predetermined distanced such that the gate substantially fills the fence opening. Upper and lower fixed-length members are mounted on the assembled upper and lower slip members for fixing the gate to a selected width. The upper and lower first slip members may be pivotally attached to the vertical members. A tress is provided, which truss extends between the upper portion of one vertical member and the lower portion of the other vertical member to maintain the gate in a predetermined parallelographic orientation.

It is an object of the invention to provide an adjustable gate which is adjustable over a set horizontal width.

Another object of the invention is to provide an adjustable gate which will follow the contour of the ground over which it extends.

Yet another object of the invention is to provide an adjustable gate which may be covered by a variety of web material, which web material conforms to that used for the fence in which the gate is inserted.

These and other objects and advantages of the invention will become more fully apparent as the description which follows is read in connection with the drawings.

DETAILED DESCRIPTION OF THE PREFERRED EMBODIMENTS

Figure 1:
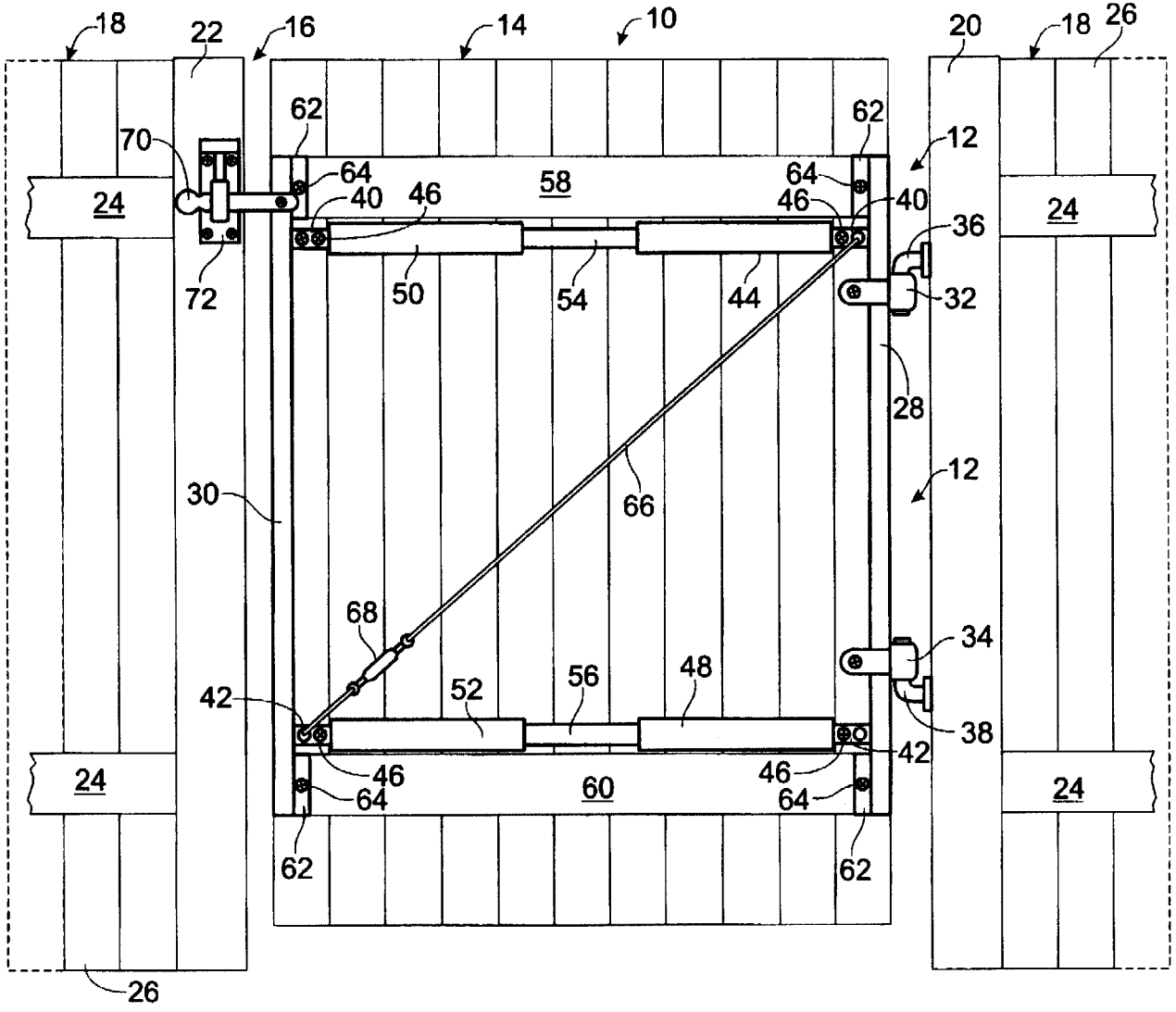
FIG. 1 depicts the adjustable gate of the invention in an environmental setting in a fence.

Referring initially to FIG. 1, the adjustable gate of the invention is depicted generally at 10. Gate 10 includes a frame 12 which receives a gate web 14 thereon. Web 14 may be made of the same material as is used in the fence. Gate 10 is located in an opening 16 in a fence 18, which fence includes a pair of spaced-apart-support posts 20, 22. Fence stringers extend horizontally from fence posts 20, 22, and provide a location to fasten the fence web 26 thereto.

Figure 2:
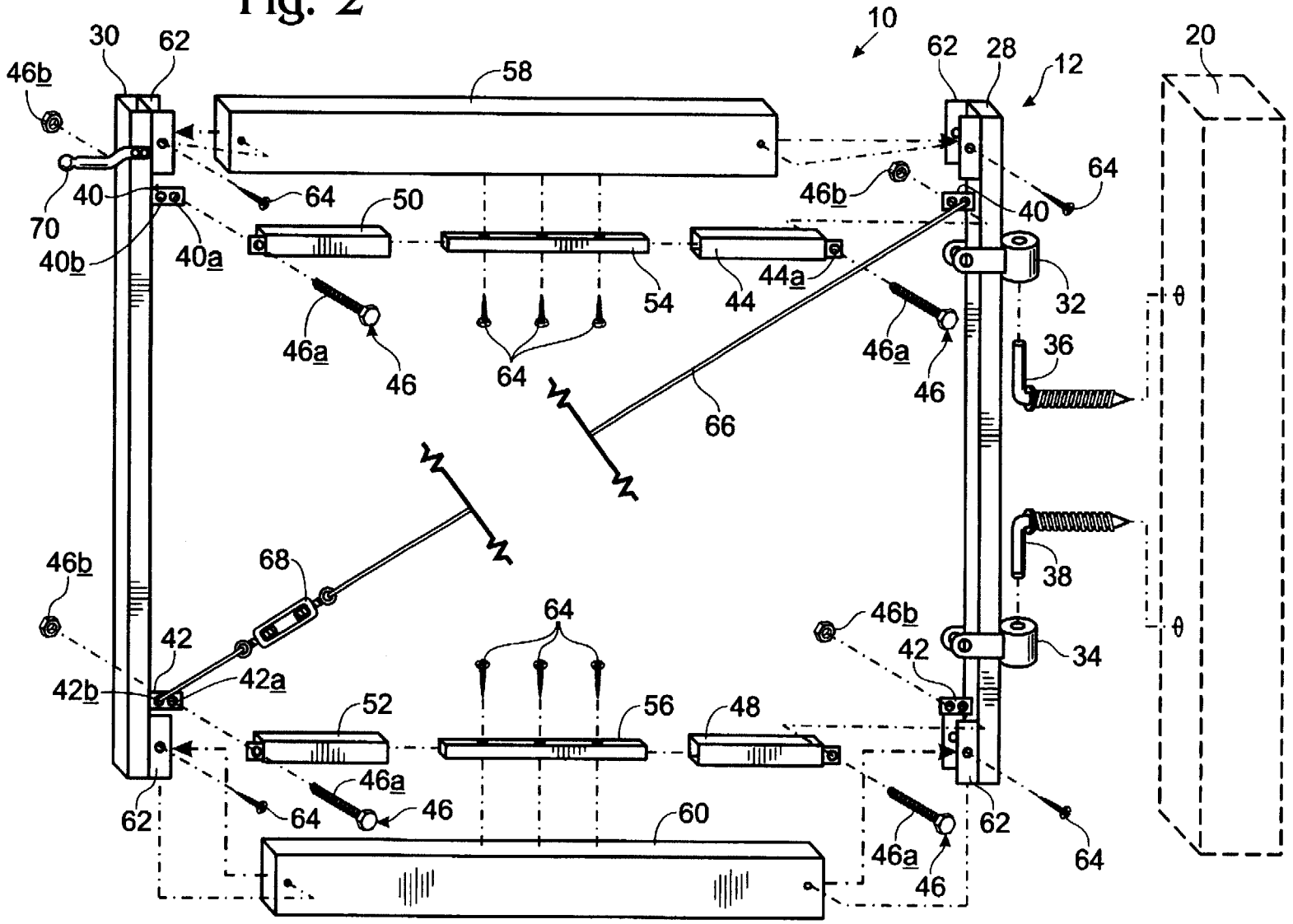
FIG. 2 is an exploded view of the framework of the adjustable gate of FIG. 1.

Referring now to FIGS. 1 and 2, frame 12 of adjustable gate 10 will be described in greater detail. Frame 12 includes a pair of spaced-apart vertical members 28, 30. One of the vertical members, 28, includes hinge members 32, 34, located thereon, which hinge members coact with hinge pins 36, 38, respectively, to allow gate 10 to pivot relative to gate-support post 20.

Each vertical member has upper and lower first slip member attachment point located thereon, in the preferred embodiment, such attachment points are located inwardly adjacent to the top and bottom ends of the vertical members. The attachment points are depicted at 40 for the upper first slip member and 42 for the lower first slip member. In this embodiment, upper first slip member 44 is pivotally attached to upper first slip member attachment point 40 by means of a fastener 46, which, in the preferred embodiment, takes the form of a bolt **46*a* and a nut 46*b*, which pass through a bore 44*a* in upper first slip member 44 and through a bore 40*a* in upper first slip member attachment point 40. Lower first slip member 48 is attached to vertical member 28 at lower first slip member attachment point 42, while upper first slip member 50 and lower first slip member 52 are attached to attachment points 40 and 42, respectively, of vertical member 30**.

An upper second slip member 54 extends between first slip members 44 and 50, while a lower second slip member 56 extends between first slip members 52 and 48. Second slip members 54 and 56 are constructed to have a slip-fit, conformal cross-section relative to the first slip members so that the second slip members are slidable relative to the first slip members. In the preferred embodiment, the second slip members are slidable within the confines of the first slip members. The assembled first and second slip members are adjustable to fix the width of the gate by slidably adjusting the first and second slip members relative to one another to a pre-determined distance, such that the gate fits in and substantially fills fence opening 16.

Once the gate has been adjusted to its proper dimension, the first and second slip members may be fixed in position relative to one another, by suitable fasteners or crimping, to maintain the width of the gate. Additionally, an upper fixed-length member 58 and a lower fixed-length member 60 are provided and are mounted on the assembled upper and lower slip members to fix the gate to a selected width. In the preferred embodiment, fixed-length member receivers 62 are provided adjacent the top and bottom of each of the vertical members and receive the ends of the fixed-length members therein. The fixed-length members are secured to frame 12 by means of suitable threaded fasteners 64.

Once the frame 12 of gate 10 is assembled, a truss 66 may be installed, with one end thereof being received in bore **40*b* of upper attachment point 40 on vertical member 28, while the other end of tress 66 is received in bore 42*b* of lower attachment point 42 on vertical member 30. A turnbuckle 68 is located intermediate to the ends of truss 60 for free adjustment of truss 66** length.

When frame 12 is assembled, it may be hung on hinge pins 36, 38 and web 14 installed thereon. Vertical member 28 is now swingingly attached to gate-support post 20. In the case of a wooden fence, the boards of web 14 will be nailed to gate 10 by nailing into upper and lower fixed-length members 58 and 60. In the case of a chain-link fence, an additional tubular web frame may be installed on frame 12, to form the full size of the gate, and the chain-link web installed there over. A latch pin 70 is installed on vertical member 30 and cooperates with a latch mechanism 72, which is located on gate support post 22.

Figure 3:
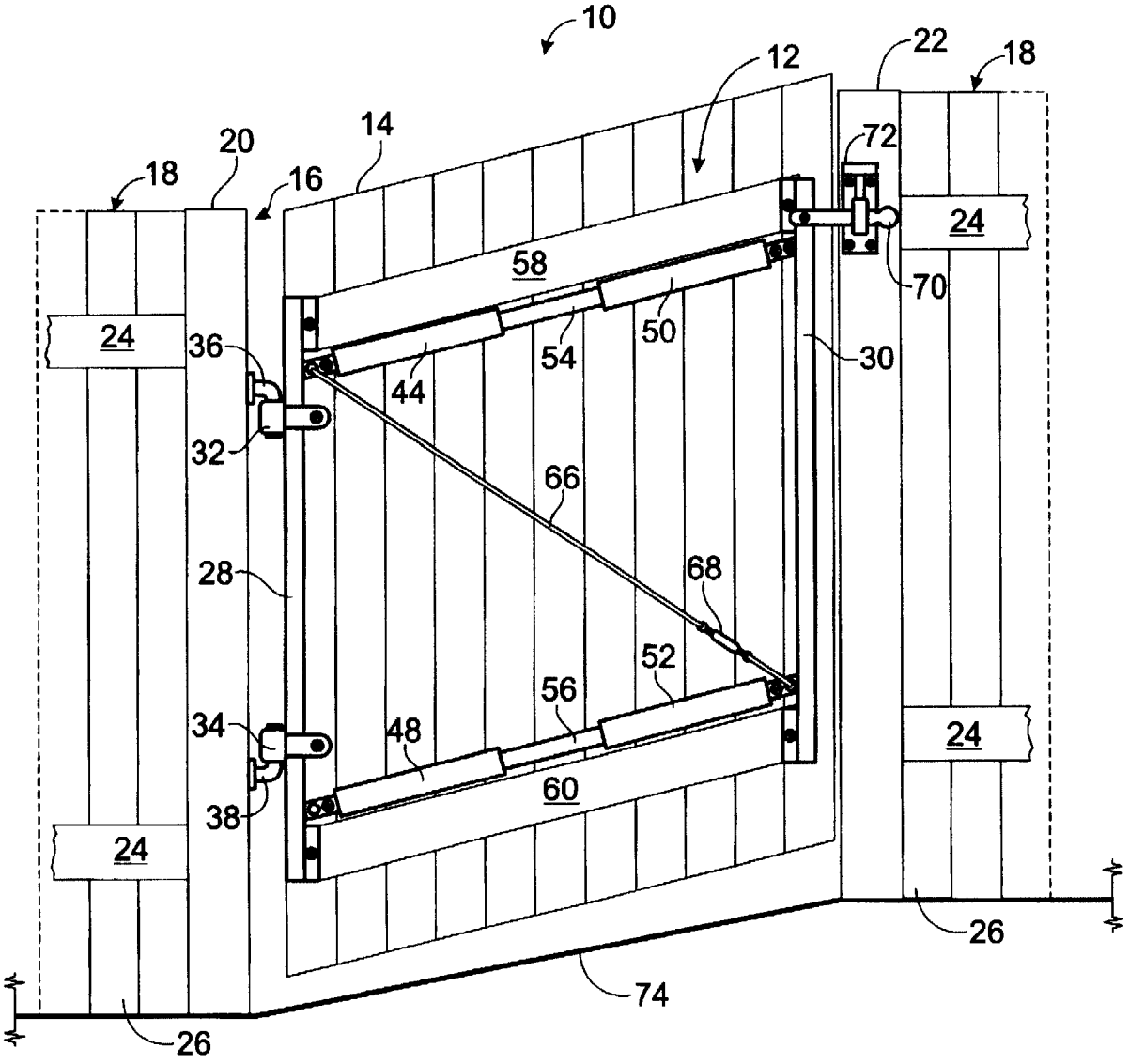
FIG. 3 depicts the gate of FIG. 1 installed over an uneven ground contour.

The finished, installed gate is depicted in FIG. 1. Turnbuckle 68 is adjusted to provide, in this installation, a square, parallelographic orientation to the gate. As used herein, "parallelographic" refers to the shape of the complete gate. In the case as shown in FIG. 1, that orientation is rectangular. The gate may also be square or, as depicted in FIG. 3, the gate may be in the form of a parallelogram wherein the opposing sides are parallel, but the angles at the corners of the side are not right angles. As shown in FIG. 3, the ground contour 74 is uneven, and gate 10 has been adjusted substantially to conform to the ground contour. This is accomplished by cutting the ends of fixed length members 58 and 60 to the same angles as is ultimately desired in the finished fence and adjusting the length of truss 66 to support the gate in its desired parallelographic orientation.

Figures 4, 5:
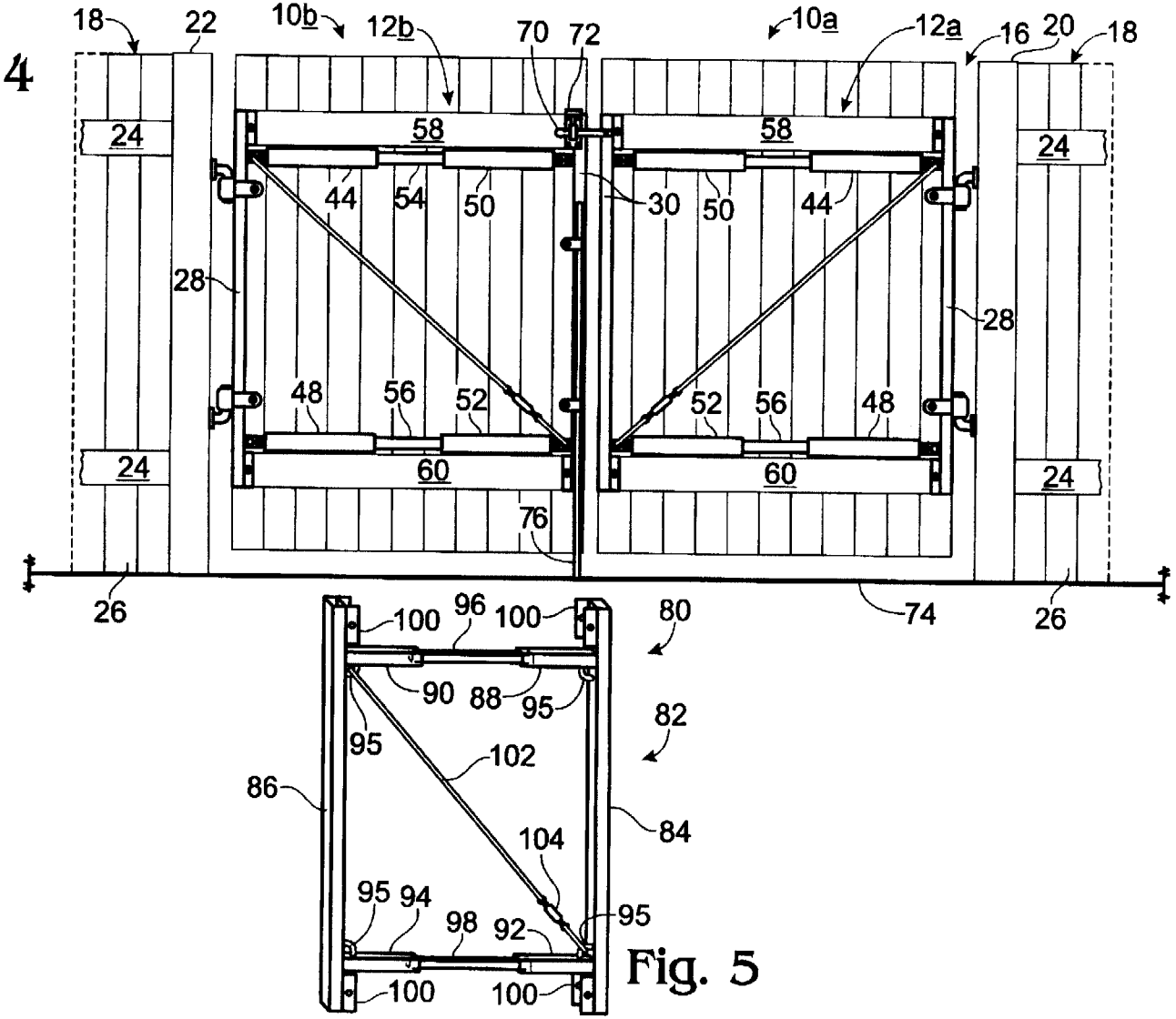
FIG. 4 depicts the adjustable gate used in a two-gate opening.
FIG. 5 depicts a second embodiment of the frame of the adjustable gate.

Referring now to FIG. 4, the adjustable gate of the invention is depicted in a double gate arrangement which includes gate segments **10*a* and 10*b*. In this instance, both of the gate support posts serve as a receptacle for hinge pins 36, 38, and the latch mechanism 72 is carried on gate segment 10*b*. A drop rod 76 is provided to secure gate segment 10*b***.

Referring now to FIG. 5, a second embodiment of the adjustable gate of the invention is depicted at 80. Only the frame 82 is depicted in FIG. 5. Frame 82 includes vertical members 84 and 86. The first slip members 88, 90, 92, and 94 are secured to their respective vertical members by means of welding. The first slip members are welded to the vertical members at a fixed angle at first slip member attachment points 95, which angle may be 90 degrees, as depicted in FIG. 5, or at a predetermined angle, as determined by the requirements of the ground contour over which the gate will be installed. The width of the gate may still be adjusted as described in connection with the embodiment depicted in FIGS. 1–3. While this embodiment does not allow the flexibility of the first embodiment described herein, it does have the advantage of being slightly less expensive to assemble and provides greater rigidity. As in the case of the previous embodiment, second slip members 96, 98 are provided as are fixed-length member receivers 100. A truss 102, having a turnbuckle 104, is also provided, and extends between attachment points 95 on vertical members 84, 86. Upper and lower fixed-length members (not shown) may be installed and the gate covered with a gate web material.

Thus, a gate structure has been disclosed which is both adjustable in width and adjustable to follow the contour of the ground over which it extends. The adjustable gate provides for an easy installation of a gate regardless of the width of a gate opening in a fence. Although a preferred embodiment of the adjustable gate, and a variation thereof, have been disclosed, it should be appreciated that further variations and modifications may be made thereto without departing from the scope of the invention as defined in the appended claims.

I claim:

1. An adjustable gate for use in a fence, wherein the fence has an opening therein, wherein the opening has a gate-support post on either side thereof, comprising:

a pair of spaced apart vertical members, one of which is swingingly attached to one of said gate-support posts;

upper and lower first slip members attached to each vertical member, wherein said upper first slip members is located adjacent the top of said vertical member and said lower first slip member is located adjacent the bottom of said vertical member;

upper and lower second slip members extending between said upper and lower first slip members, respectively, wherein said second slip members have a slip-fit, conformal cross-section such that said second slip member slidably fits on said first slip member, the assembled first and second slip members being adjustable to fix the width of the gate by slidably adjusting said first and second slip members relative to one another to a predetermined distance such that the gate substantially fills the fence opening; and upper and lower fixed-length members mounted on said assembled upper and lower slip members, respectively, and attached thereto for fixing the gate to a selected width.

2. The adjustable gate of claim 1 wherein said first slip members are pivotally attached to said vertical members, and which further includes a truss extending between an upper region of one vertical member and a lower region of the other vertical member for maintaining the gate in a predetermined parallelographic orientation.

3. The adjustable gate of claim 1 wherein said first slip members are fixedly attached to said vertical members at a predetermined angle.

4. The adjustable gate of claim 1 wherein said second slip members are received within said first slip members.

5. The adjustable gate of claim 1 wherein said fixed length members are secured to said assembled upper and lower slip members by threaded fasteners.

6. The adjustable gate of claim 1 wherein said other vertical member includes a latch mechanism for latching the gate in a closed condition.

7. An adjustable gate for use in a fence, wherein the fence has an opening therein, wherein the opening has a gate-support post on either side thereof, comprising:

a pair of spaced apart vertical members, one of which is swingingly attached to one of said gate-support posts, and which includes upper and lower first slip member attachment points and upper and lower fixed-length member receivers thereon;

upper and lower fast slip members pivotally attached to each vertical member at said upper and lower first slip member attachment points, respectively, wherein said upper first slip member is located adjacent the top of said vertical member and said lower first slip member is located adjacent the bottom of said vertical member;

upper and lower second slip members extending between said upper and lower first slip members, respectively, wherein said second slip members have a slip-fit, conformal cross-section such that said second slip member slidably fits on said first slip member, the assembled first and second slip members being adjustable to fix the width of the gate by slidably adjusting said first and second slip members relative to one another to a predetermined distance such that the gate substantially fills the fence opening;

a truss extending between an upper first slip member attachment point on one vertical member and a lower first slip member attachment point on the other vertical member for maintaining the gate in a predetermined parallelographic orientation; and upper and lower fixed-length members mounted in said fixed-length member receiver and on said assembled upper and lower slip members, respectively, and attached thereto for fixing the gate to a selected width.

8. The adjustable gate of claim 7 wherein said second slip members are received within said first slip members.

9. The adjustable gate of claim 7 wherein said fixed length members are secured to said assembled upper and lower slip members by threaded fasteners.

10. The adjustable gate of claim 7 wherein said other vertical member includes a latch mechanism for latching the gate in a closed condition.

11. An adjustable gate for use in a fence, wherein the fence has an opening therein, wherein the opening has a gate-support post on either side thereof, comprising:

a gate frame, including:

a pair of spaced apart vertical members, one of which is swingingly attached to one of said gate-support posts;

upper and lower first slip members attached to each vertical member, wherein said upper first slip member is located adjacent the top of said vertical member and said lower first slip member is located adjacent the bottom of said vertical member;

upper and lower second slip members extending between said upper and lower first slip members, respectively, wherein said second slip members have a slip-fit, conformal cross-section such that said second slip member slidably fits within said fast slip member, the assembled first and second slip members being adjustable to rye the width of the gate by slidably adjusting said first and second slip members relative to one another to a predetermined distance such that the gate substantially fills the fence opening; and upper and lower fixed-length members mounted on said assembled upper and lower slip members, respectively, and attached thereto for fixing the gate to a selected width; and a gate web attached to said gate frame.

12. The adjustable gate of claim 11 wherein said first slip members are pivotally attached to said vertical members, and which further includes a truss extending between an upper region of one vertical member and a lower region of the other vertical member for maintaining the gate in a predetermined parallelographic orientation.

13. The adjustable gate of claim 11 wherein said first slip members are fixedly attached to said vertical members at a predetermined angle.

14. The adjustable gate of claim 11 wherein said fixed length members are secured to said assembled upper and lower slip members by threaded fasteners.

15. The adjustable gate of claim 11 wherein said other vertical member includes a latch mechanism for latching the gate in a closed condition.

16. The adjustable gate of claim 11 wherein said gate web is attached to said upper and lower fixed-length members.

17. The adjustable gate of claim 11 which further includes a web frame for attaching said gate web thereto, wherein said web frame is attached to said gate frame.

* * * * *